US008393117B2

(12) United States Patent
Muir

(10) Patent No.: US 8,393,117 B2
(45) Date of Patent: Mar. 12, 2013

(54) WALL FLASHING

(76) Inventor: Anthony Robert Muir, Wellington (NZ)

( * ) Notice: Subject to any disclaimer, the term of this patent is extended or adjusted under 35 U.S.C. 154(b) by 0 days.

(21) Appl. No.: 13/192,327

(22) Filed: Jul. 27, 2011

(65) Prior Publication Data

US 2013/0019543 A1 Jan. 24, 2013

Related U.S. Application Data

(63) Continuation of application No. 11/326,002, filed on Jan. 5, 2006, now abandoned.

(51) Int. Cl.
*E04D 15/00* (2006.01)

(52) U.S. Cl. ..... 52/97; 52/58; 52/61

(58) Field of Classification Search ..... 52/58–62, 52/97, 289, 408, 410, 698
See application file for complete search history.

(56) References Cited

U.S. PATENT DOCUMENTS

| | | | | |
|---|---|---|---|---|
| 4,485,600 | A * | 12/1984 | Olson | 52/62 |
| 5,027,572 | A * | 7/1991 | Purcell et al. | 52/309.9 |
| 5,201,156 | A * | 4/1993 | Newman | 52/299 |
| 5,884,435 | A * | 3/1999 | David et al. | 52/62 |
| 6,945,004 | B1 * | 9/2005 | Ghiringhelli | 52/650.3 |
| 7,254,926 | B2 * | 8/2007 | Eldeen | 52/698 |

* cited by examiner

*Primary Examiner* — Jeanette E Chapman
*Assistant Examiner* — Daniel Kenny
(74) *Attorney, Agent, or Firm* — Weiss & Moy, P.C.; Jeffrey D. Moy

(57) ABSTRACT

Building means, having a main plate 1, a flexible sheet 2 attached thereto, a first bolt portion 4 extending outwards of the plate 1 and an opposite second bolt portion 5 extending outwards of the plate. The building means formed such that when it is in use a structural member can be fastened to the first bolt 4 portion while at the same time the plate 1 is arranged behind exterior cladding 8 of a building. A ledge 2*a*, after it has been bent into shape, extends to beyond the cladding so that rainwater contacting the first face of the plate portion can run down the first face and be guided by the ledge to a drain away position in front of the cladding.

7 Claims, 3 Drawing Sheets

WALL FLASHING

RELATED APPLICATIONS

This application is a continuation of U.S. patent application Ser. No. 11/326,002, filed Jan. 5, 2006, now abandoned in the name of the same inventor, and claims the benefit thereof.

FIELD OF THE INVENTION

This invention relates to building means. A preferred form of the invention relates to means for use in attaching structural members at or adjacent the exterior cladding of a house or other building.

BACKGROUND

It is often necessary to fix structural members such as deck joists or pergola beams to the exterior part of a building. This presents a problem in that the point of contact between the structural member and the building may provide an area where rainwater is able to enter the building and, over time, cause rot or other damage to internal wall framing, etc. It is accordingly an object of one form of the present invention to go at least some way towards addressing this problem, or to provide the public with a useful choice.

The term "comprising", "comprises", or derivatives thereof, if and when used herein, should be interpreted non-exclusively—ie to convey "consisting of or including".

SUMMARY OF THE INVENTION

According to one aspect of the invention there is provided building means, having a main plate portion, a flexible sheet extending from the plate portion wherein that sheet can be bent by hand to create a ledge, a first bolt portion extending outwards of a first face of the plate portion and a second bolt portion extending outwards of a second face of the plate portion opposite the first face; the building means being formed such that when it is in use a structural member can be fastened to the first bolt portion while at the same time the plate portion is arranged at least partially behind exterior cladding of a building and wherein the ledge, after it has been bent into shape, extends to beyond the cladding, wherein rainwater contacting the first face of the plate portion can run down the first face and be guided by the ledge to a drain away position in front of the cladding.

Preferably the building means has supportive packing on the first face of the plate portion and the first bolt portion extends outwardly from the supportive packing.

Preferably the main plate portion is at least substantially formed from a corrosion resistant metallic substance—eg stainless steel.

According to another aspect of the invention there is provided a method of securing a structural member (eg a joist) adjacent a building (eg a house), involving the steps of:

i) taking a building means as described above, ii) arranging the main plate portion between wall framing and external cladding of the building and creating the ledge so that the ledge and the first bolt portion extend to positions in front of the cladding with the second bolt portion secured to the wall framing, and iii) securing a structural member (eg a joist) to the first bolt portion, the method being such that in the event rainwater contacts the plate portion it is able to drain to the ledge, and then from the ledge in front of the cladding.

According to another aspect of the invention there is provided means installed on a building, the building means having a main plate portion, a flexible sheet extending from the plate portion wherein the flexible sheet is of a of a type that can be bent by hand to create a ledge during or prior to installation, a first bolt portion extending outwards of a first face of the plate portion and a second bolt portion extending outwards of a second face of the plate portion opposite the first face; the building means being such that a structural member is fastened to the first bolt portion and the second bolt portion is fastened to the building, the plate portion is arranged at least partially behind exterior cladding of the building, and the ledge extends to beyond the cladding and downwards so that when it rains rainwater contacting the first face of the plate portion is able to run down the first face and be guided by the ledge to a drain away position in front of the cladding.

DESCRIPTION OF THE DRAWINGS

Some preferred embodiments of the invention will now be described by way of example with reference to the accompanying drawings, of which.

DETAILED DESCRIPTION

Figure 1:
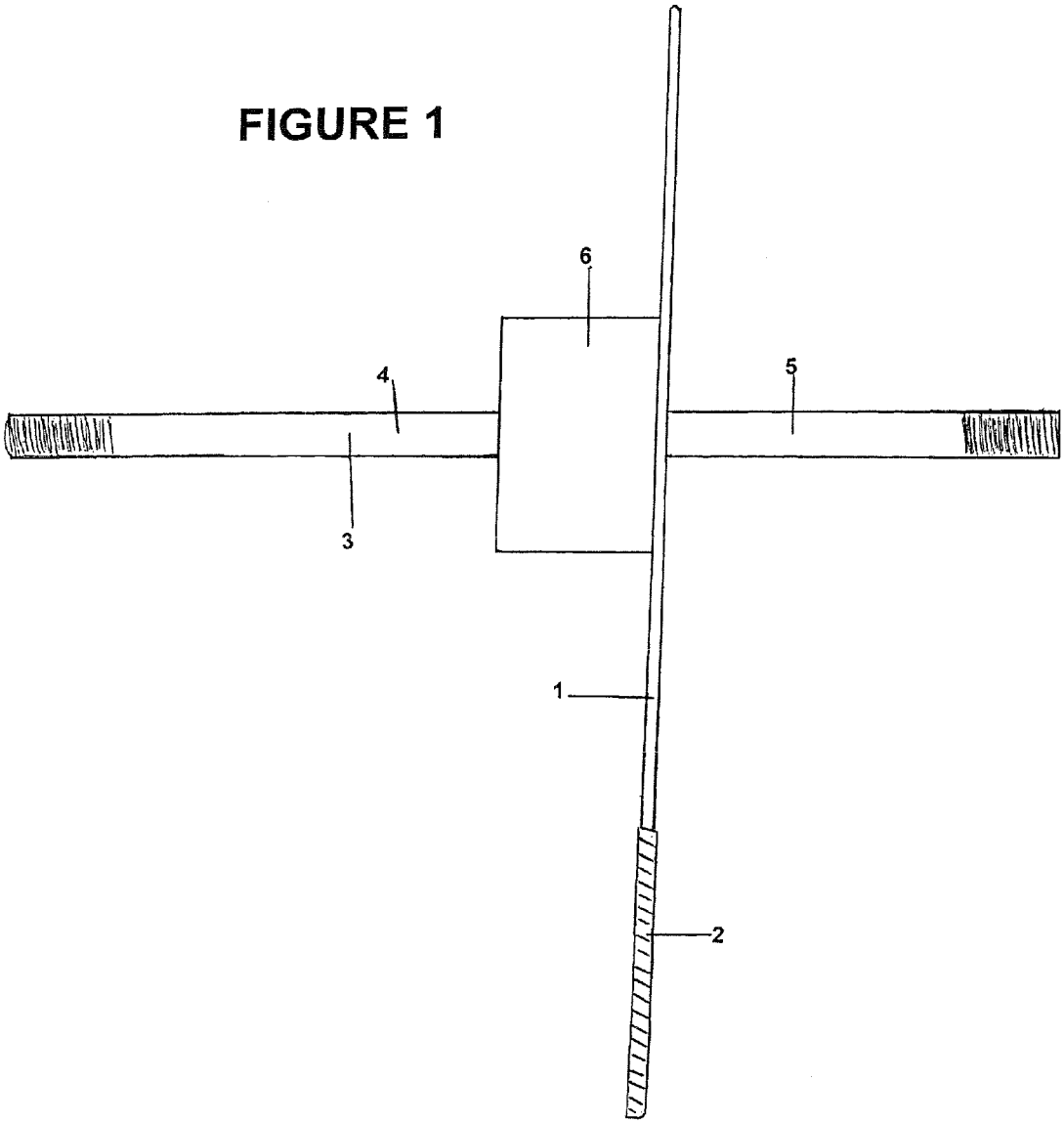
FIG. 1 is a side elevation view of a connector prior to installation.
Figure 2:
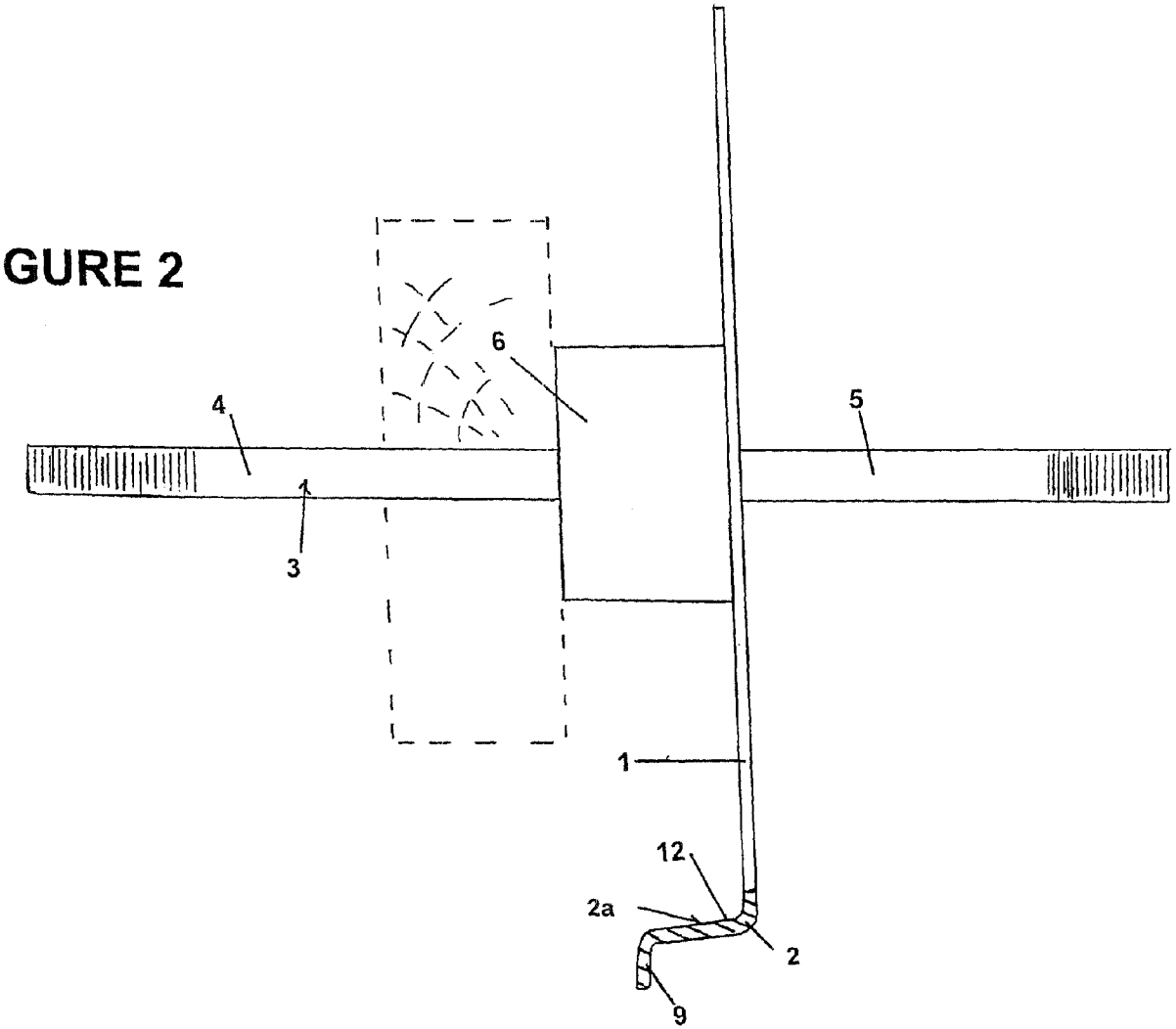
FIG. 2 is a side elevation view of the connector when adapted for installation, together with a joist shown in broken lines.
Figure 3:
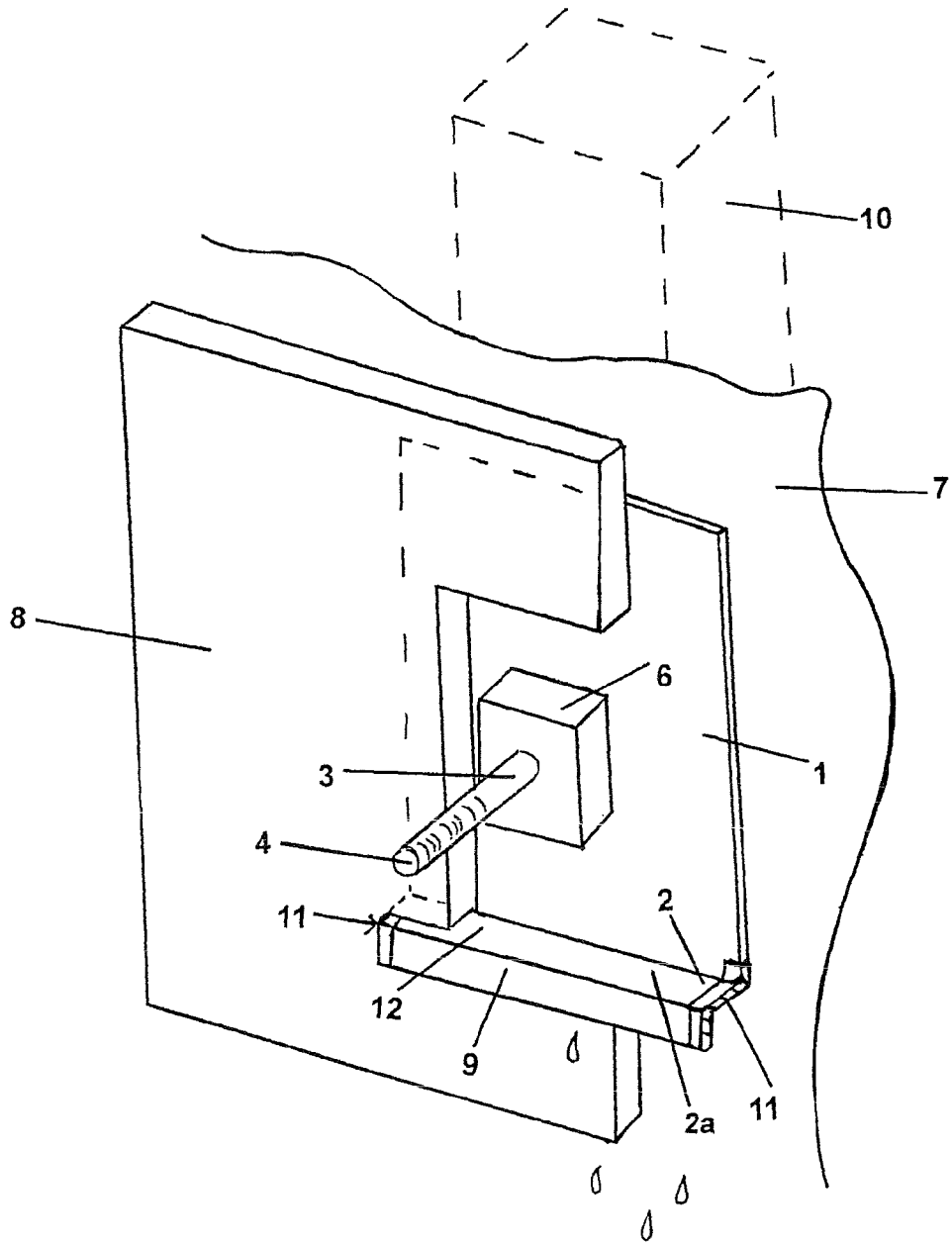
FIG. 3 is a perspective view of the connector when installed and ready for use.

As shown in FIG. 1, the connector comprises a main plate 1 and a flexible sheet 2 attached to a lower part thereof. The flexible sheet 2 can be readily bent by hand to form a ledge 2*a* as shown in FIG. 2. The bend is such that the ledge 2*a* turns out from the plate 1 at slightly more than 90 degrees and then downwards to run parallel to the plate 1. The flexible sheet 2 may be substantially thinner than the main plate 1 and is secured to that plate by folding it around the lower side edge parts of the plate and pressing it there to give a tight fit. The flexible sheet 2 is thus a double layer at its side parts (the folds run the whole length of its sides and the extent of the folding is best seen in FIG. 3) but is otherwise in one layer only. A threaded bolt 3 which has a first portion 4 and a second portion 5 passes at right angles through the plate 1 and through a supportive packing block 6 on a first face of the plate.

Referring to FIG. 3, when the connector is in use (and with the ledge 2*a* formed therein) it is arranged against building paper 7 laid over the exterior wall framing 10 of a house or other building. More specifically, the plate 1 is between the building paper/framing on one hand and the building's exterior wall cladding 8 on the other. Preferably the connector is arranged at a position where two sheets of exterior cladding butt up against one another, although for the sake of clarity FIG. 3 only shows one such sheet 8. FIG. 3 shows that a recess has been cut in the cladding 8 to accommodate the connector. The ledge 2*a* extends from the plate 1 to a position in front of the cladding. As also shown in FIG. 3, the down-turned part 9 of the ledge is slightly in front of the cladding.

The connector is secured to the internal wall framing 10 behind the building paper 7 by way of the second portion 5 of the bolt 3. The first portion 4 of the bolt and the block 6 extend outwards of the plate 1 to positions in front of the cladding 8. A joist or other structural member can be butted against the block 6 and secured to the first portion 4 of the bolt—ie after drilling a hole in the joist and passing the bolt therethrough. The joist may or may not be part of a deck area. Preferably silicon sealant is placed between the cladding and the connector to assist in creating a weatherproof arrangement. Weatherproofing may also be assisted by applying adhesive building tape over the main edges of the plate 1 where these meet the building paper 7.

When the invention is in use rainwater which is able to get in behind the joist contacts the plate 1 and runs down to the ledge 2*a*. The ledge guides the rainwater away from the plate to a position in front of the cladding 8. From there the rain water is able to drip from the down-turned part 9 of the ledge rather than enter wall cavity and cause timber rot or other damage. To assist in directing water away from the connector the edges 11 of the outward extending part 12 of the ledge may be formed with a very slight "up turn" to assist in directing the rainwater to the down turned part 9. Referring to FIG. 2, the outward extending part 12 is at an angle of just over 90 degrees with respect to the plate 1. This enables gravity to assist rainwater to drain away from the plate rather than undesirably collect on the outward extending part 12 of the ledge.

Preferably the plate 1 and the packing block 6 are formed from stainless steel or some other corrosion resistant metallic substance. The block 6 may be substantially hollow, although that is not essential. Preferably the flexible sheet is formed from BITU-AL or some other suitable substance.

While some preferred forms of the invention have been described by way of example it should be appreciated that modifications and improvements can occur without departing from the scope of the appended claims.

The invention claimed is:

1. Building means, having a main plate portion, a flexible sheet extending from the main plate portion wherein that sheet can be bent by hand to create a ledge, a first bolt portion extending outwards of a first face of the main plate portion and a second bolt portion extending outwards of a second face of the main plate portion opposite the first face; the building means fixed to a building wherein a structural member is fastened to the first bolt portion and the main plate portion is arranged at least partially behind exterior cladding of the building and wherein the ledge has been bent into shape so that it extends in front of the cladding, the building means arranged such that when rainwater contacts the first face of the main plate portion the rainwater can run down the first face and be guided by the ledge to a drain away position in front of the cladding.

2. Building means according to claim 1, having supportive packing on the first face of the main plate portion and wherein the first bolt portion extends outwardly from the supportive packing.

3. Building means according to claim 1, having supportive packing on the first face of the main plate portion and wherein the first bolt portion extends outwardly from the supportive packing, and wherein the main plate portion is at least substantially formed from a corrosion resistant metallic substance.

4. Building means according to claim 1, having supportive packing on the first face of the main plate portion and wherein the first bolt portion extends outwardly from the supportive packing, wherein the main plate portion is at least substantially formed from a corrosion resistant metallic substance, and wherein the flexible sheet is of a different corrosion resistant metallic substance to the main plate portion.

5. Building means installed on a building, the building means having a main plate portion, a flexible sheet extending from the main plate portion wherein the flexible sheet is of a type that can be bent by hand to create a ledge during or prior to installation, a first bolt portion extending outwards of a first face of the main plate portion and a second bolt portion extending outwards of a second face of the main plate portion opposite the first face; the building means being such that a structural member is fastened to the first bolt portion and the second bolt portion is fastened to the building, the main plate portion is arranged at least partially behind exterior cladding of the building, and the ledge extends in front of the cladding and extends downwards so that when it rains rainwater contacting the first face of the plate portion is able to run down the first face and be guided by the ledge to a drain away position in front of the cladding.

6. Building means installed according to claim 5, wherein the building means has supportive packing on the first face of the main plate portion and the first bolt portion extends outwardly from the supportive packing, the structural member is adjacent the packing, the main plate portion is at least substantially formed from a corrosion resistant metallic substance, and wherein the flexible sheet is of a different corrosion resistant metallic substance to the main plate portion.

7. A method of securing a structural member adjacent to a building, comprising the steps of:

i) taking a building means, the building means having a main plate portion, a flexible sheet extending from the main plate portion wherein the sheet can be bent by hand to create a ledge, a first bolt portion extending outwards of a first face of the main plate portion and a second bolt portion extending outwards of a second face of the main plate portion opposite the first face, ii) arranging the main plate portion between wall framing and external cladding of the building so that the ledge and the first bolt portion extend to positions in front of the cladding with the second bolt portion secured to the wall framing, and iii) securing a structural member to the first bolt portion, the method being such that in the event rainwater contacts the plate portion it is able to drain to the ledge, and then from the ledge in front of the cladding.

* * * * *